US005133861A

United States Patent [19]

Grieve

[11] Patent Number: 5,133,861

[45] Date of Patent: Jul. 28, 1992

[54] HYDRICYCLONE SEPARATOR WITH TURBULENCE SHIELD

[75] Inventor: Donald F. Grieve, La Honda, Calif.

[73] Assignee: Krebs Engineers, Menlo Park, Calif.

[21] Appl. No.: 727,665

[22] Filed: Jul. 9, 1991

[51] Int. Cl.[5] ..... B04C 3/00

[52] U.S. Cl. ..... 210/512.1; 210/787; 55/459.1; 209/144; 209/211

[58] Field of Search ..... 210/512.1, 512.2, 787; 55/459.1; 209/211, 144

[56] References Cited

U.S. PATENT DOCUMENTS

| | | | |
|---|---|---|---|
| 4,576,724 | 3/1983 | Colman et al. | 210/512.1 |
| 4,721,565 | 1/1988 | Carroll | 210/512.1 |
| 4,749,490 | 6/1988 | Smyth et al. | 210/512.1 |
| 4,842,145 | 6/1989 | Broadway | 209/211 |
| 4,855,066 | 8/1984 | Petty et al. | 210/512.2 |
| 4,876,016 | 10/1989 | Young et al. | 210/512.1 |
| 4,964,994 | 10/1990 | Wakley et al. | 210/512.1 |
| 5,002,671 | 3/1991 | de Villiers et al. | 209/144 |
| 5,017,288 | 5/1991 | Thew et al. | 210/512.1 |

*Primary Examiner*—Robert A. Dawson
*Assistant Examiner*—David Reifsnyder
*Attorney, Agent, or Firm*—Flehr, Hohbach, Test, Albritton & Herbert

[57] ABSTRACT

Hydrocyclone separator for separating liquids of different densities such as oil and water. The separator has an axially elongated chamber, a feed inlet for introducing liquid into the chamber at high velocity in a tangential directionso that the liquid rotates about the axis of the chamber, an overflow outlet for removing the less dense liquid from the chamber, and an underflow outlet for removing the more dense liquid from the chamber. A turbulence shield is positioned between the feed inlet and the axially disposed outlet for isolating the overflow outlet from the effects of turbulence produced by the liquid entering the chamber.

25 Claims, 3 Drawing Sheets

EFFECT OF TURBULENCE SHIELD ON SEPARATION

HYDRICYCLONE SEPARATOR WITH TURBULENCE SHIELD

This invention pertains generally to centrifugal separators and, more particularly, to cyclone separating apparatus for use with liquids of different densities, such as oil and water.

Cyclone separators have heretofore been provided for separating a variety of materials from each other in accordance with their relative densities, such as solid/-liquid separations in the mining and chemical processing industries. Cyclones separators are also used for separating liquids of different densities such as oil and water, and one example of a cyclone with parameters optimized for separating oil and water is found in U.S. Pat. No. 4,964,994. Other examples of liquid/liquid separators designed for separating oil and water are found in U.S. Pat. Nos. 4,576,724, 4,721,565, 4,747,490 and 4,876,016.

In a liquid/liquid separator, the liquid is typically introduced into a chamber at high velocity in a tangential direction to produce centrifugal forces which separate the liquid into components of greater and lesser density, with the lighter or less dense liquid being concentrated in a core at the axis of the chamber and the heavier or more dense liquid being concentrated toward the outer wall. The lighter liquid is usually removed through an overflow outlet at the end of the chamber near the feed inlet, and the heavier liquid is removed through an underflow outlet at the other end.

The high velocity of the liquid at the feed inlet can create a turbulence which extends throughout the entire cross-section of the chamber near the inlet, producing instability in the core of lighter or less dense liquid and reducing the efficiency with which this portion of the liquid is collected at the overflow outlet. The turbulence can also produce a so-called "short circuiting" effect in which some of the incoming liquid passes directly to the overflow outlet without being separated into its heavier and lighter components.

It is in general an object of the invention to provide a new and improved hydrocyclone separator.

Another object of the invention is to provide a hydrocyclone separator of the above character which overcomes the limitations and disadvantages of separators heretofore provided.

Another object of the invention is to provide a hydrocyclone separator of the above character which is particularly suited for use in separating oil and water.

These and other objects are achieved in accordance with the invention by providing a hydrocyclone separator having an axially elongated chamber, a feed inlet for introducing liquid into the chamber at high velocity in a tangential direction so that the liquid rotates about the axis of the chamber, an axially disposed outlet for removing the less dense liquid from the chamber, means for removing the more dense liquid from the chamber, and a turbulence shield interposed between the feed inlet and the axially disposed outlet for isolating the outlet from the effects of turbulence produced by the liquid entering the chamber.

Figure 1:
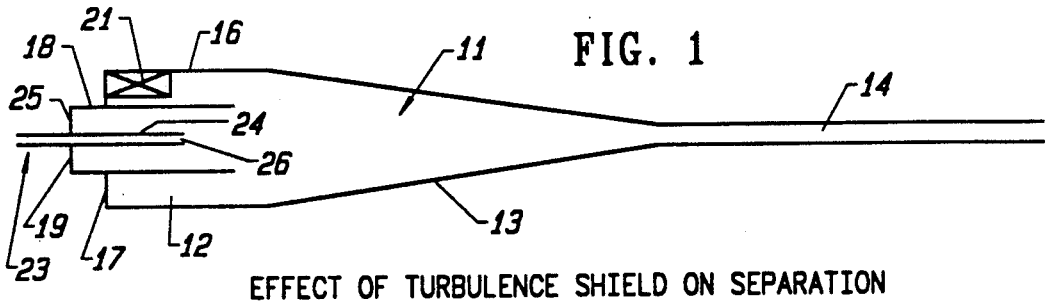
FIG. 1 is a cross-sectional view, somewhat schematic, of one embodiment of a hydrocyclone separator incorporating the invention.

As illustrated in FIG. 1, the hydrocyclone separator has an axially elongated chamber 11 with a relatively short inlet section 12, a conically tapered section 13, and an outlet section or tail piece 14. The chamber typically has a diameter on the order of 3 inches at the inlet end about ¾ to 1 inch at the outlet end, with conical section and tail piece having lengths on the order of 20–27 inches and 36–54 inches, respectively.

At the inlet end, the chamber has a cylindrical side wall 16 and an annular end wall 17, with a cylindrical sleeve 18 extending through the annular wall and having an end cap or cover plate 19 at the outer end thereof. A feed inlet 21 opens through the side wall for introducing liquid at high velocity in a tangential direction into the region between the side wall and the sleeve for rotation about the axis of the chamber. The feed inlet can be of any suitable cross-sectional shape and size, such as an oval, round or rectangular.

An overflow outlet 23 passes through end cap 19 for removing the lighter or less dense liquid from the chamber. In the embodiment of FIG. 1, the overflow outlet includes a vortex finder tube 24 which extends coaxially within sleeve 18 and passes through an opening 25 in the end cap. The tube has an axial passageway 26 of suitable diameter for removing the lighter liquid, e.g. 1/16 inch for removing oil.

Sleeve 18 extends within the chamber beyond the inner end of the vortex finder tube and beyond the feed inlet. It extends outside annular wall 17 a distance on the order of twice the diameter of the chamber. The sleeve can have an outside diameter on the order of 25 to 75 percent of the diameter of the large end of the chamber, e.g an outside diameter of 1 7/8 inches, and a wall thickness on the order of 1/16 inch. The portion of the sleeve within the chamber is, thus, interposed between the feed inlet and the overflow outlet, and it serves as a shield which isolates core of lighter fluid and the overflow outlet from the effects of turbulence produced by the introduction of liquid into the chamber at high velocity. It stabilizes the core of oil or other lighter liquid, prevents short circuiting between the feed inlet and the overflow outlet, and improves collection efficiency.

Figure 2:
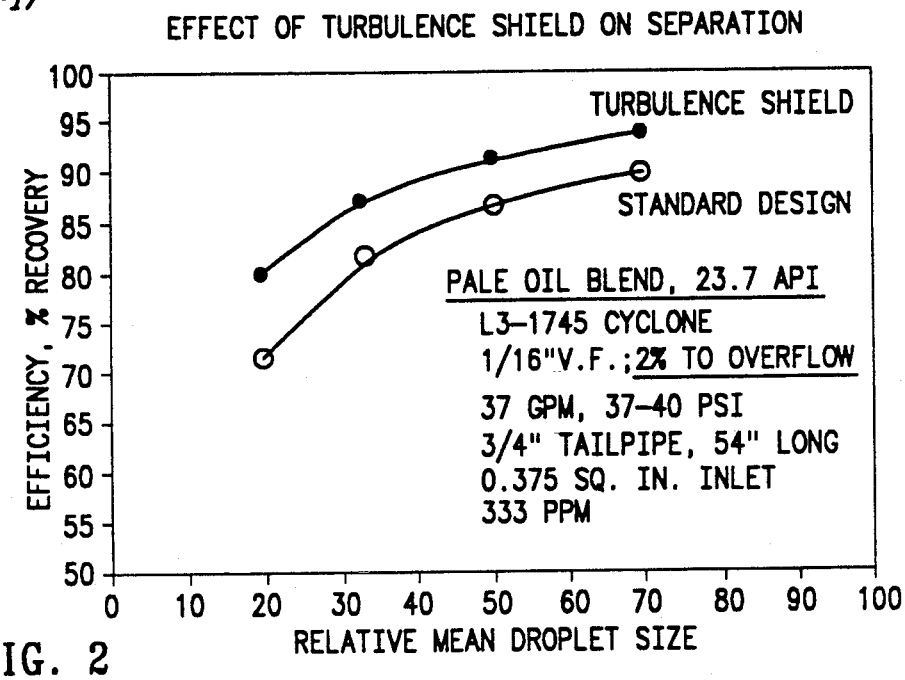
FIGS. 2 and 3 are graphical representations of the separation efficiency of a hydrocyclone separator according to the invention.
Figure 3:
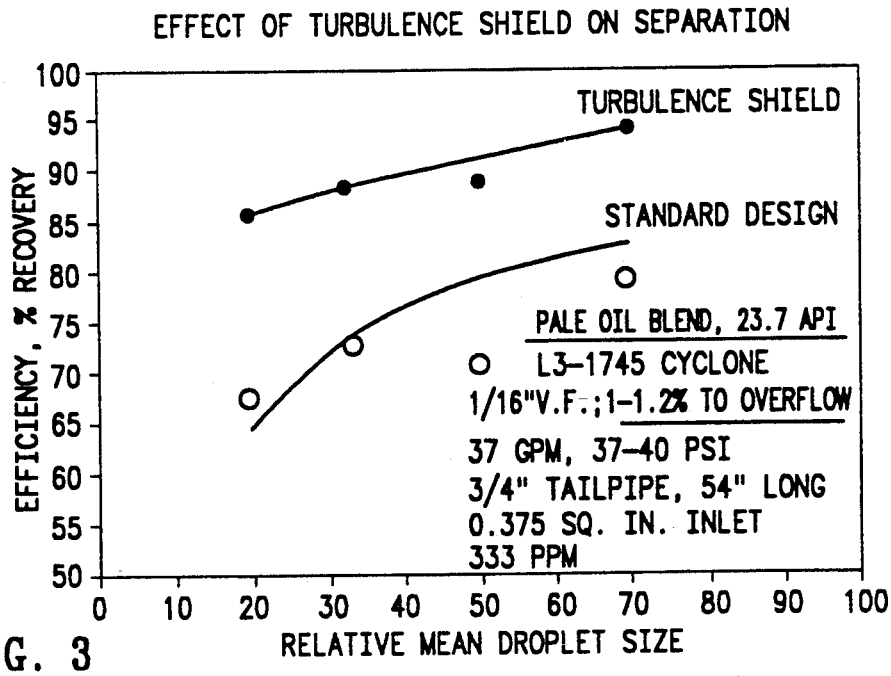

The improvement in collection efficiency is illustrated graphically in FIGS. 2 and 3 where collection efficiency is plotted as a function of relative mean droplet size. In each figure, the upper curve shows the results obtained with a cyclone having a turbulence shield in accordance with the invention, and the lower curve shows the results obtained with the same cyclone without the shield. This particular cyclone had a 0.375 square inch feed inlet, a 1/16 inch vortex finder, and a tailpipe having a diameter of ¾ inch and a length of 54 inches. A mixture of oil and water was supplied to the cyclone at a rate of 37 gallons per minute with a pressure drop across the cyclone of 37–40 PSI.

In the tests illustrated in FIG. 2, the flow split between the overflow and underflow outlets was set to deliver 2 percent of the liquid to the overflow outlet. With this flow split, the turbulence shield increased the recovery rate or collection efficiency by between about 5 and 10 percent for different droplet sizes. This is a significant improvement.

In the tests illustrated in FIG. 3, the flow split was set to deliver between 1 and 1.2 percent of the liquid to the overflow outlet, and the improvement provided by the shield was even more dramatic, being on the order of 15 to 20 percent for different droplet sizes.

These tests demonstrate that the beneficial effects of the turbulence shield are most pronounced at lower flow splits, where instability is more of a problem. The lowest possible flow split consistent with satisfatory efficiency is highly desirable in commercial operation, however, the existing state of the art cyclone tends to become increasingly unstable under low flow split conditions. In contrast the turbulence shield is stable at low flow split conditions, making this device greatly superior for commercial operation.

Figure 4:
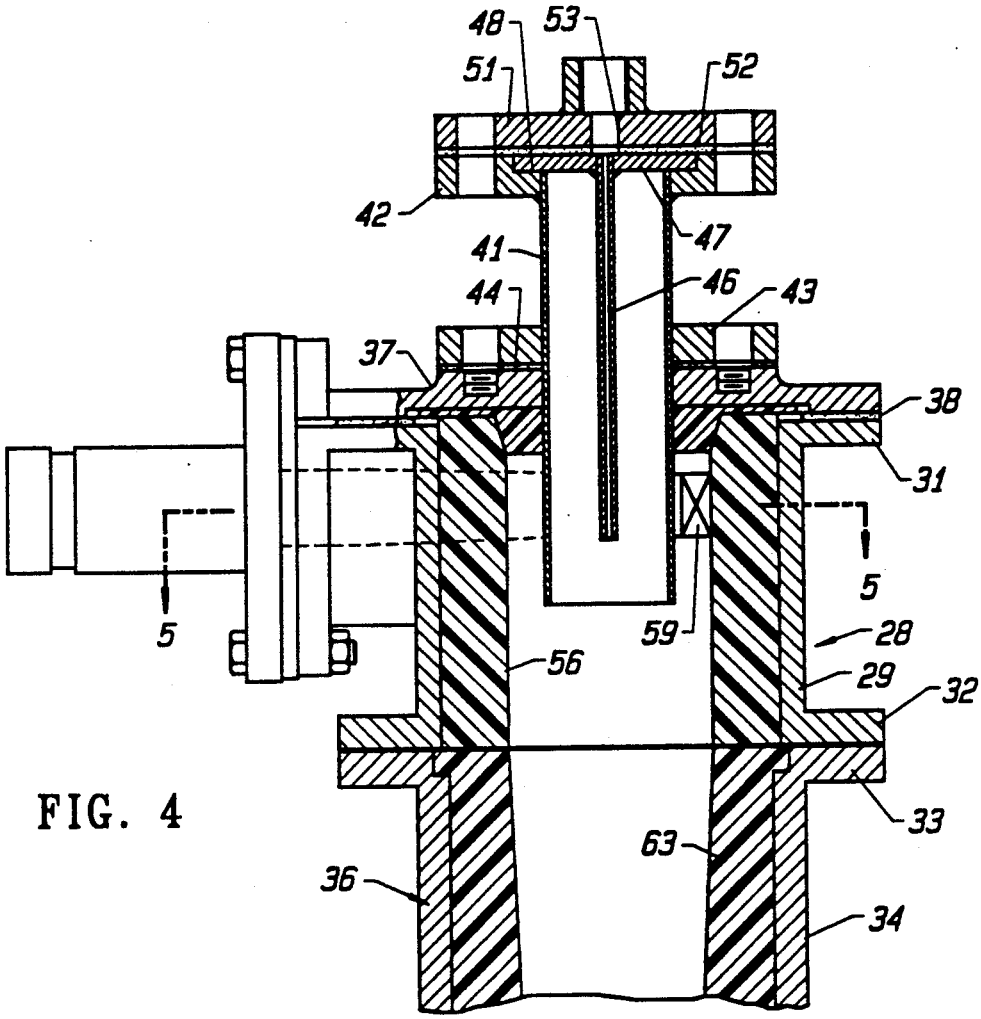
FIG. 4 is a fragmentary cross-sectional view of a portion of an embodiment similar to the embodiment of FIG. 1.
Figure 5:
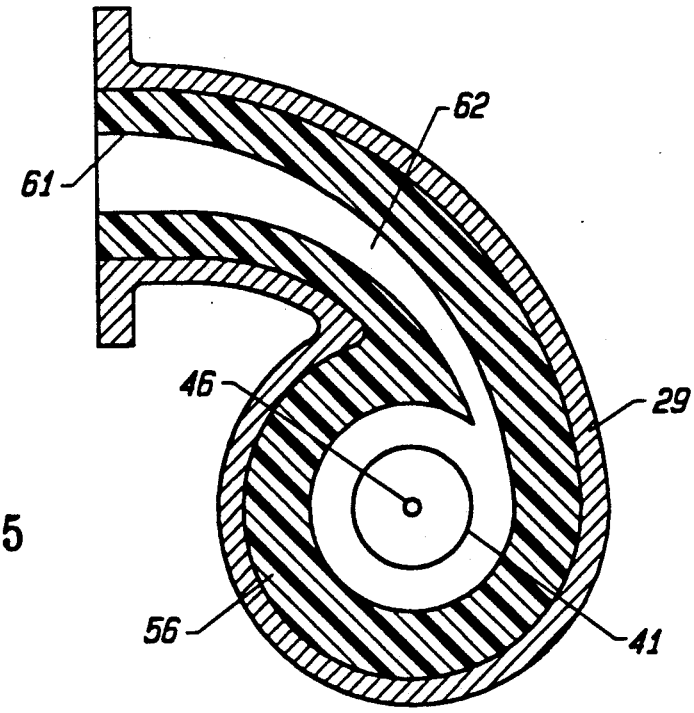
FIG. 5 is a cross-sectional view taken along line 5—5 in FIG. 4.

In the embodiment illustrated in FIG. 4, the inlet section has a steel housing 28 with a cylindrical side wall 29 and flanges 31, 32 at the upper and lower ends of the side wall. Lower flange 32 is bolted to a flange 33 at the upper end of side wall 34 of conical section 36, and an annular head piece 37 is bolted to upper flange 31, with a gasket 38 providing a liquid tight seal between the head piece and the flange. Cylindrical sleeve 41 is welded to an annular flange 42 at the upper end thereof and to an annular flange 43 about midway along its length. The sleeve passes through the opening in headpiece 37, and flange 43 is bolted to the upper side of the head piece, with the sleeve positioned coaxially of housing wall 29 and a gasket 44 between the flange and the head piece. A vortex finder tube 46 is welded to an annular flange 47 which is received in a counterbore 48 in the upper side of flange 42. A cover plate 51 is bolted to flange 42, with a gasket 52 providing a seal between the cover plate, flange 42 and the vortex finder flange. The cover plate has an axial opening 53 aligned with the vortex finder tube, with a threaded fitting on the upper side of the plate communicating with the passageway for connection to a suitable outlet line (not shown).

The inlet section has an elastomeric liner 56 (e.g., urethane) adjacent to side wall 29 and a headliner 57 on the underside of head piece 37. Feed inlet 59 comprises a tangentially extending port 61 which opens through side wall 29 and an involute passageway 62 of rectangular cross-section in liner 56. The side wall 34 of conical section 36 has a liner 63.

As in the embodiment of FIG. 1, the lower end of sleeve 41 extends below the lower end of vortex finder tube 46 and below the feed inlet 59 to shield the vortex finder and the core of oil or other liquid from the effects of the turbulence produced by liquid entering the chamber at high velocity.

Figure 6:
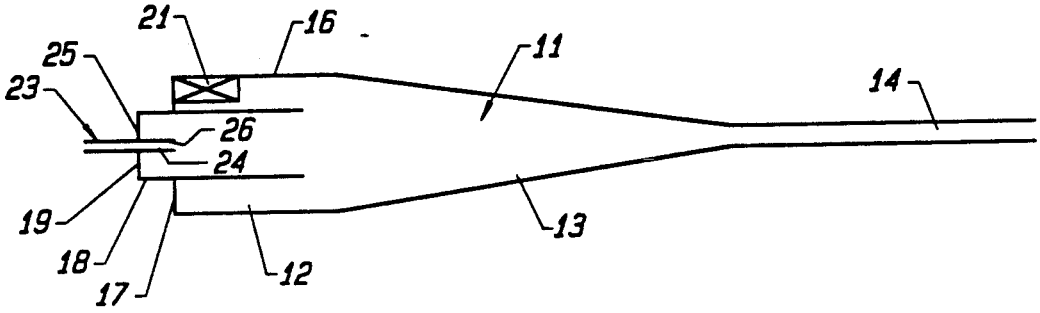
FIGS. 6 and 7 are cross-sectional views, somewhat schematic, of additional embodiments of a hydrocyclone separator incorporating the invention.
Figure 7:
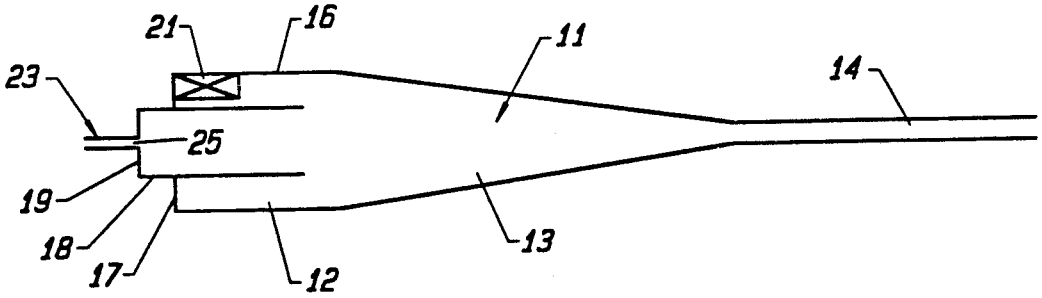

The embodiments of FIGS. 6 and 7 are similar to the embodiment of FIG. 1, and like reference numerals designate corresponding elements in the three figures. In the embodiment of FIG. 6, however, the vortex finder tube 24 extends only a short distance into the sleeve beyond annular wall 14. In the embodiment of FIG. 7, there is no vortex finder tube, and the opening 25 in end wall 19 serves as the overflow outlet. Operation and use of these embodiments is similar to that of the other embodiments, with the cylindrical sleeve 18 again shielding the core of oil and the overflow outlet from the turbulence produced by liquid entering the chamber at high velocity.

It is apparent from the foregoing that a new and improved hydrocyclone separator has been provided. While only certain presently preferred embodiments have been described in detail, as will be apparent to those familiar with the art, certain changes and modifications can be made without departing from the scope of the invention as defined by the following claims.

I claim:

1. In a hydrocyclone separator for separating a less dense liquid from a more dense liquid: a chamber having a cylindrical section and a conically tapered section aligned along an axis, a feed inlet in the cylindrical section for introducing liquid into the chamber at high velocity in a tangential direction so that the liquid rotates about the axis and the less dense liquid forms into a core along the axis, an axially disposed outlet in the cylindrical section for removing the core of less dense liquid from the chamber, means for removing the more dense liquid from the conical section, and a cylindrical shield of greater in diameter than the outlet disposed coaxially within the cylindrical section between the feed inlet and the outlet for isolating the core from the effects of turbulence produced by liquid entering the chamber as the core approaches the outlet.

2. The hydrocyclone separator of claim 1 wherein the cylindrical shield has a diameter on the order of 25 to 75 percent of the diameter of the cylindrical section.

3. The hydrocyclone separator of claim 1 wherein the outlet comprises an orifice at one end of the chamber.

4. The hydrocyclone separator of claim 1 including a cylindrical tailpiece connected to the conically tapered section.

5. In a hydrocyclone separator for separating a less dense liquid from a more dense liquid: a chamber having a cylindrical section and a conically tapered section aligned along an axis, a feed inlet in the cylindrical section for introducing liquid into the chamber at high velocity in a tangential direction so that the liquid rotates about the axis, a vortex finder tube which extends coaxially within the cylindrical section for removing the less dense liquid from the chamber, means for removing the more dense liquid from the conical section, and a cylindrical shield disposed coaxially of the vortex finder tube for isolating liquid approaching the vortex finder tube from the effects of turbulence produced b y liquid entering the chamber.

6. In a hydrocyclone separator for separating a less dense liquid from a more dense liquid: a chamber which is elongated along an axis, a feed inlet for introducing liquid into the chamber at high velocity in a tangential direction so that the liquid rotates about the axis and the less dense liquid forms into a core along the axis, an axially disposed outlet for removing the core of less dense liquid from the chamber, means for removing the more dense liquid from the chamber, and a turbulence shield of greater diameter than the outlet interposed between the feed inlet and the outlet for isolating the core from the effects of turbulence produced by liquid entering the chamber as the core approaches the outlet.

7. The hydrocyclone separator of claim 6 wherein the axially disposed outlet comprises an orifice at one end of the chamber.

8. In a hydrocyclone separator for separating a less dense liquid from a more dense liquid: a chamber which is elongated along an axis, a feed inlet for introducing liquid into the chamber at high velocity in a tangential direction so that the liquid rotates about the axis, a vortex finder tube which extends along the axis for removing the less dense liquid from the chamber, means for removing the more dense liquid from the chamber, and a turbulence shield disposed coaxially of the vortex finder tube for isolating liquid approaching the vortex finder tube from the effects of turbulence produced by liquid entering the chamber.

9. In a hydrocyclone separator for separating a less dense liquid from a more dense liquid: a chamber which is elongated along an axis, a feed inlet near one end of the chamber for introducing liquid into the chamber at high velocity in a tangential direction so that the liquid rotates about the axis and the less dense liquid forms into a core along the axis, an axially disposed outlet toward the same end of the chamber as the feed inlet for removing the less dense liquid from the chamber, means at the other end of the chamber for removing the more dense liquid from the chamber, and a turbulence shield of greater diameter than the outlet interposed between the feed inlet and the outlet for isolating the core from the effects of turbulence produced by liquid entering the chamber as the core approaches the outlet.

10. The hydrocyclone separator of claim 9 wherein the axially disposed outlet comprises an orifice at the one end of the chamber.

11. In a hydrocyclone separator for separating a less dense liquid from a more dense liquid: a chamber which is elongated along an axis, a feed inlet near one end of the chamber for introducing liquid into the chamber at high velocity in a tangential direction so that the liquid rotates about the axis, a vortex finder tube which extends along the axis, an axially disposed outlet toward the same end of the chamber as the feed inlet for removing the less dense liquid from the chamber, means at the other end of the chamber for removing the more dense liquid from the chamber, and a turbulence shield disposed coaxially of the vortex finder tube for isolating liquid approaching the vortex finder tube from the effects of turbulence produced by liquid entering the chamber.

12. In a hydrocyclone separator: a conical section having ends of greater and lesser diameter, an inlet section aligned along an axis with the conical section at the end of greater diameter and having a cylindrical side wall and an annular end wall, a cylindrical sleeve disposed coaxially within the inlet section and extending through the annular wall, an end wall at an outer end of the sleeve, a feed inlet which opens through the side wall for introducing liquid into the region between the side wall and the sleeve at high velocity so that the liquid rotates about the axis and centrifugal forces effect a radial separation of less dense and more dense components of the liquid, an axially disposed outlet of smaller diameter than the sleeve opening through the wall at the outer end of the sleeve for removing the less dense component, and means communicating with the conical section toward the end of lesser diameter for removing the more dense component.

13. The hydrocyclone separator of claim 12 wherein the axially disposed outlet comprises an opening in the wall at the outer end of the sleeve.

14. The hydrocyclone of claim 12 wherein the sleeve has a diameter on the order of 25 to 75 percent of the diameter of the side wall.

15. In a hydrocyclone separator: a conical section having ends of greater and lesser diameter, an inlet section aligned along an axis with the conical section at the end of greater diameter and having a cylindrical side wall and an annular end wall, a cylindrical sleeve disposed coaxially within the inlet section and extending through the annular wall, an end wall at an outer end of the sleeve, a feed inlet which opens through the side wall for introducing liquid into the region between the side wall and the sleeve at high velocity so that the liquid rotates about the axis and centrifugal forces effect a radial separation of less dense and more dense components of the liquid, a vortex finder tube which extends coaxially within the sleeve and through the wall at the outer end of the sleeve for removing the less dense component, and means communicating with the conical section toward the end of lesser diameter for removing the more dense component.

16. In a hydrocyclone separator: a conical section having ends of greater and lesser diameter, an inlet section aligned along an axis with the conical section at the end of greater diameter and having a cylindrical side wall, a cylindrical extension of lesser diameter than the cylindrical side wall aligned axially with the side wall at the end of the side wall opposite the conical section, an end wall at an outer end of the cylindrical extension, a feed inlet which opens through the side wall for introducing liquid into the inlet section at high velocity so that the liquid rotates about the axis and centrifugal forces effect a radial separation of less dense and more dense components of the liquid, an axially disposed outlet opening of smaller diameter than the extension in the end wall of the extension for removing the less dense component, a cylindrical shield of greater diameter than the outlet opening disposed coaxially within the inlet section in alignment with the cylindrical extension for isolating liquid approaching the outlet from the effects of turbulence produced by liquid entering the inlet section, and means communicating with the conical section toward the end of lesser diameter for removing the more dense component.

17. The hydrocyclone separator of claim 16 including an external tube in communication with the opening in the wall at the outer end of the cylindrical extension.

18. The hydrocyclone of claim 16 wherein the shield has a diameter on the order of 25 to 75 percent of the diameter of the side wall.

19. In a hydrocyclone separator: a conical section having ends of greater and lesser diameter, an inlet section aligned along an axis with the conical section at the end of greater diameter and having a cylindrical side wall, a cylindrical extension of lesser diameter than the cylindrical side wall aligned axially with the side wall at the end of the side wall opposite the conical section, an end wall at an outer end of the cylindrical extension, a feed inlet which opens through the side wall for introducing liquid into the inlet section at high velocity so that the liquid rotates about the axis and centrifugal forces effect a radial separation of less dense and more dense components of the liquid, a vortex finder tube which extends through the end wall of the extension for removing the less dense component, a cylindrical shield disposed coaxially of the vortex finder tube within the inlet section for isolating liquid approaching the vortex finder tube from the effects of turbulence produced by liquid entering the inlet section, and means communicating with the conical section toward the end of lesser diameter for removing the more dense component.

20. The hydrocyclone separator of claim 19 wherein the vortex finder tube also extends into the shield.

21. In a hydrocyclone for separating a less dense liquid from a more dense liquid: a chamber having an axis, a feed inlet for introducing liquid into the chamber at high velocity so that the liquid rotates about the axis and the less dense liquid forms into a core along the axis, an axially disposed outlet opening for removing the core of less dense liquid from the chamber, and a shield of greater diameter than the outlet opening positioned between the feed inlet and the outlet opening for isolating a portion of the core leading to the outlet opening from the effects of turbulence produced by liquid entering the chamber.

22. In a hydrocyclone for separating a less dense liquid from a more dense liquid: a chamber having an axis, a feed inlet for introducing liquid into the chamber at high velocity so that the liquid rotates about the axis and the less dense liquid forms into a core along the axis, an axially extending vortex finder tube for removing the core of less dense liquid from the chamber, and a shield of greater diameter than the vortex finder tube disposed coaxially of the vortex finder tube for isolating a portion of the core leading to the vortex finder tube from the effects of turbulence produced by liquid entering the chamber.

23. In a hydrocyclone for separating a less dense liquid from a more dense liquid: a chamber having an axis, a feed inlet for introducing liquid into the chamber at high velocity so that the liquid rotates about the axis and the less dense liquid forms into a core along the axis, an axially disposed vortex finder tube for removing the core of less dense liquid from the chamber, and shield means for stabilizing the core of less dense liquid before it enters the vortex finder tube.

24. The hydrocyclone of claim 23 wherein the means for stabilizing the core comprises a shield of greater diameter than the vortex finder tube positioned between the feed inlet and the vortex finder tube for isolating the core of less dense liquid from the effects of turbulence produced by liquid entering the chamber.

25. In a hydrocyclone for separating a less dense liquid from a more dense liquid: a chamber having an axis, a feed inlet for introducing liquid into the chamber at high velocity so that the liquid rotates about the axis and the less dense liquid forms into a core along the axis, an axially disposed outlet opening for removing the core of less dense liquid from the chamber, and a cylindrical sleeve positioned coaxially within the chamber adjacent to the feed inlet and extending axially beyond the chamber, with the outlet opening being of smaller diameter than the sleeve and being disposed at an end of the sleeve outside the chamber so that the core of less dense liquid will travel through the sleeve and beyond the chamber before reaching the outlet opening.

* * * * *